US007934408B2

(12) United States Patent
Hasegawa et al.

(10) Patent No.: US 7,934,408 B2
(45) Date of Patent: May 3, 2011

(54) ROLLER HEMMING METHOD AND HEMMED MEMBER

(75) Inventors: Eisaku Hasegawa, Tochigi (JP); Hiroshi Miwa, Tochigi (JP); Katsumi Takeishi, Tochigi (JP); Takeshi Nakamura, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 542 days.

(21) Appl. No.: 11/905,892

(22) Filed: Oct. 5, 2007

(65) Prior Publication Data

US 2008/0092618 A1 Apr. 24, 2008

(30) Foreign Application Priority Data

Oct. 20, 2006 (JP) ..... P.2006-286771

(51) Int. Cl.
*B21D 7/02* (2006.01)
*B23P 11/00* (2006.01)

(52) U.S. Cl. ..... 72/214; 72/220; 29/243.58

(58) Field of Classification Search ..... 72/214, 72/220, 306, 322, 323, 363, 409.18; 29/243.58
See application file for complete search history.

(56) References Cited

U.S. PATENT DOCUMENTS

| | | | | |
|---|---|---|---|---|
| 3,522,784 | A | 8/1970 | Moxley | |
| 5,315,855 | A | 5/1994 | Jackson et al. | |
| 6,769,164 | B2 * | 8/2004 | Zubcevic | 29/509 |
| 7,347,072 | B2 * | 3/2008 | Miller et al. | 72/214 |
| 2006/0070418 | A1 * | 4/2006 | Quell | 72/214 |
| 2006/0075797 | A1 * | 4/2006 | Baulier et al. | 72/220 |

FOREIGN PATENT DOCUMENTS

| | | | |
|---|---|---|---|
| DE | 296 06 725 | U1 | 9/1996 |
| DE | 103 38 170 | B4 | 12/2005 |
| DE | 10 2005 004 474 | B3 | 8/2006 |
| DE | 10 2005 012 310 | B3 | 10/2006 |
| EP | 1 162 011 | A3 | 7/2003 |
| GB | 2 439 693 | A | 12/2005 |
| JP | A-2005-3005357 | | 11/1993 |
| WO | WO 2006/117896 | A1 | 11/2006 |

* cited by examiner

*Primary Examiner* — Debra M Sullivan
(74) *Attorney, Agent, or Firm* — Arent Fox LLP

(57) ABSTRACT

In a roller hemming method for folding a flange erected from a workpiece by pressing a working roller against the flange and moving the working roller relative to the flange, the flange is folded by: a first temporary bending step of bending a tip-side portion of the flange into a state that the tip-side portion is inclined; a second temporary bending step of bending a remaining, base-side portion of the flange into a state that the base-side portion is inclined; and a full bending step of bending the thus-bent flange into a final shape so that the flange is into contact with a flange-proximate portion.

1 Claim, 9 Drawing Sheets

ROLLER HEMMING METHOD AND HEMMED MEMBER

This application claims foreign priority from Japanese Patent Application No. 2006-286771 filed on Oct. 20, 2006, the entire contents of which are hereby incorporated by reference.

BACKGROUND OF THE INVENTION

1. Field of the Invention

The present invention relates to a roller hemming method for folding, by a working roller, a flange that is erected from a workpiece, as well as to a hemmed member.

2. Related Art

A roller hemming apparatus for hemming a workpiece by a working roller is known.

The roller hemming apparatus is configured so that an arm of a robot is provided with a working roller and the working roller can be moved along a flange of a workpiece by moving the arm in three-dimensions.

In order to hem the flange of the workpiece by the roller hemming apparatus, first, a locus along which to move the working roller is determined by teaching (follow operation). Information of the thus-determined locus is stored in a control section of the robot.

After the locus information has been stored, the workpiece is placed at a working position. The working roller is moved on the basis of the locus information in a state that the workpiece is placed at the working position.

The working roller is moved along the flange in the state that the working roller is pressed to the flange.

As described above, the hemming method is known in which locus information is obtained in advance by teaching and a flange of a workpiece is folded so as to be brought into contact with the main body of the workpiece by moving a working roller along the flange by controlling the robot on the basis of the thus-obtained locus information (refer to JP-A-05-305357, for example).

It is preferable that the tip of the flange be kept in contact with the main body of the workpiece even after the flange is folded so as to come into contact with the main body of the workpiece.

When the flange is folded by the working roller, the flange is folded at its base end. However, the flange tends to be inclined slightly in such a manner that its distance from the main body of the workpiece increases as the position goes from the base end to the tip. That is, the tip of the flange tends to be separated from the main body of the work.

SUMMARY OF THE INVENTION

One or more embodiments of the present invention provide a roller hemming method capable of establishing a state that a tip of a flange is kept in contact with a main body of a workpiece, as well as a resulting hemmed member.

According to a first aspect of the invention, in a roller hemming method for folding a flange erected from a workpiece by pressing a working roller to the flange and moving the working roller relative to the flange, the flange is bent by: a first temporary bending step of bending a tip-side portion of the flange into a first state in which the tip-side portion is inclined; a second temporary bending step of bending a remaining, base-side portion of the flange into a second state in which the base-side portion is inclined; and a full bending step of bending the thus-bent flange into a third state in which the flange is into contact with a main body of the workpiece.

According to a second aspect of the invention, the working roller may include: a full bending portion for bending the flange into the third state; and a tapered temporary bending portion which is provided on a tip side of the full bending portion and serves to bend the flange into the first and second states. In addition, the flange may be bent into each of the first and second states by abase-side portion of the temporary bending portion.

It is conceivable to provide a working roller with a tapered temporary bending portion and fold a flange into a temporary bent state using the entire temporary bending portion. However, if the flange is folded with the entire temporary bending portion, a waving phenomenon occurs in the folded flange.

In view of this, in the second aspect of the invention, the flange is bent into each of the first and second states by the base-side portion of the temporary bending portion.

According to a third aspect of the invention, a hemmed member which is formed by folding a flange of a workpiece is provided with: a base-side bent portion formed on a base end side of the flange and inclined in a direction away from a main body of the workpiece such that a distance between the flange and the main body becomes greater toward a central portion of the flange from the base end; and a tip-side bent portion formed on a tip end side of the flange and inclined in a direction toward the main body such that the distance between the flange and the main body decreases towards the tip end of the flange from the central portion.

In the first aspect of the invention, the tip-side portion of the flange is bent so as to be inclined in the first temporary bending step and the remaining, base-side portion is bent so as to be inclined in the second temporary bending step. As a result, the flange is folded so as to assume a generally chevron-like shape.

When the flange has been folded so as to assume a generally chevron-like shape, the flange is rendered in a state that a crease is formed at the central portion or a curved state that a crease is not formed at the central portion.

The flange that has been folded so as to assume a generally chevron-like shape is bent into a final shape so that its tip is contact with the main body of the workpiece.

The flange having the final shape is inclined so as to go away from the main body of the workpiece as the position goes from the base end to the central portion and to come closer to the main body of the workpiece as the position goes from the central portion to the tip.

This provides an advantage that the tip of the flange can be kept in contact with the main body of the workpiece even after the flange is folded into the final shape.

There may occur a case that the crease formed in the generally chevron-shaped flange disappears when the working roller is pressed against the flange.

Even in this case, stress that urges the flange to restore a generally chevron-like shape remains in the flange. This makes it possible to keep the tip of the flange in contact with the workpiece even in the case where a crease formed in the flange disappears in the full bending step.

In the second aspect of the invention, when the flange is bent by the tapered temporary bending portion, the flange is bent into each of the first and second states by the base-side portion of the temporary bending portion.

Therefore, it is not necessary to bend the flange into the temporary bent state using the entire temporary bending portion. This provides an advantage that a waving phenomenon can be prevented from occurring in the flange that has been bent into the temporary bent state and hence the flange can be folded satisfactorily.

In the third aspect of the invention, the flange of the hemmed member has the base-side bent portion which is inclined so as to go away from the main body of the workpiece as the position goes from the base end to a central portion and the tip-side bent portion is inclined so as to come closer to the main body of the workpiece as the position goes from the central portion to the tip.

This provides an advantage that the tip of the flange can be kept in contact with the main body of the workpiece, that is, the tip of the flange can be prevented from lifting up.

Other aspects and advantages of the invention will be apparent from the following description and the appended claims.

DETAILED DESCRIPTION OF THE EXEMPLARY EMBODIMENTS

Exemplary embodiments of the invention will be hereinafter described with reference to the accompanying drawings.

First Exemplary Embodiment

Figure 1:
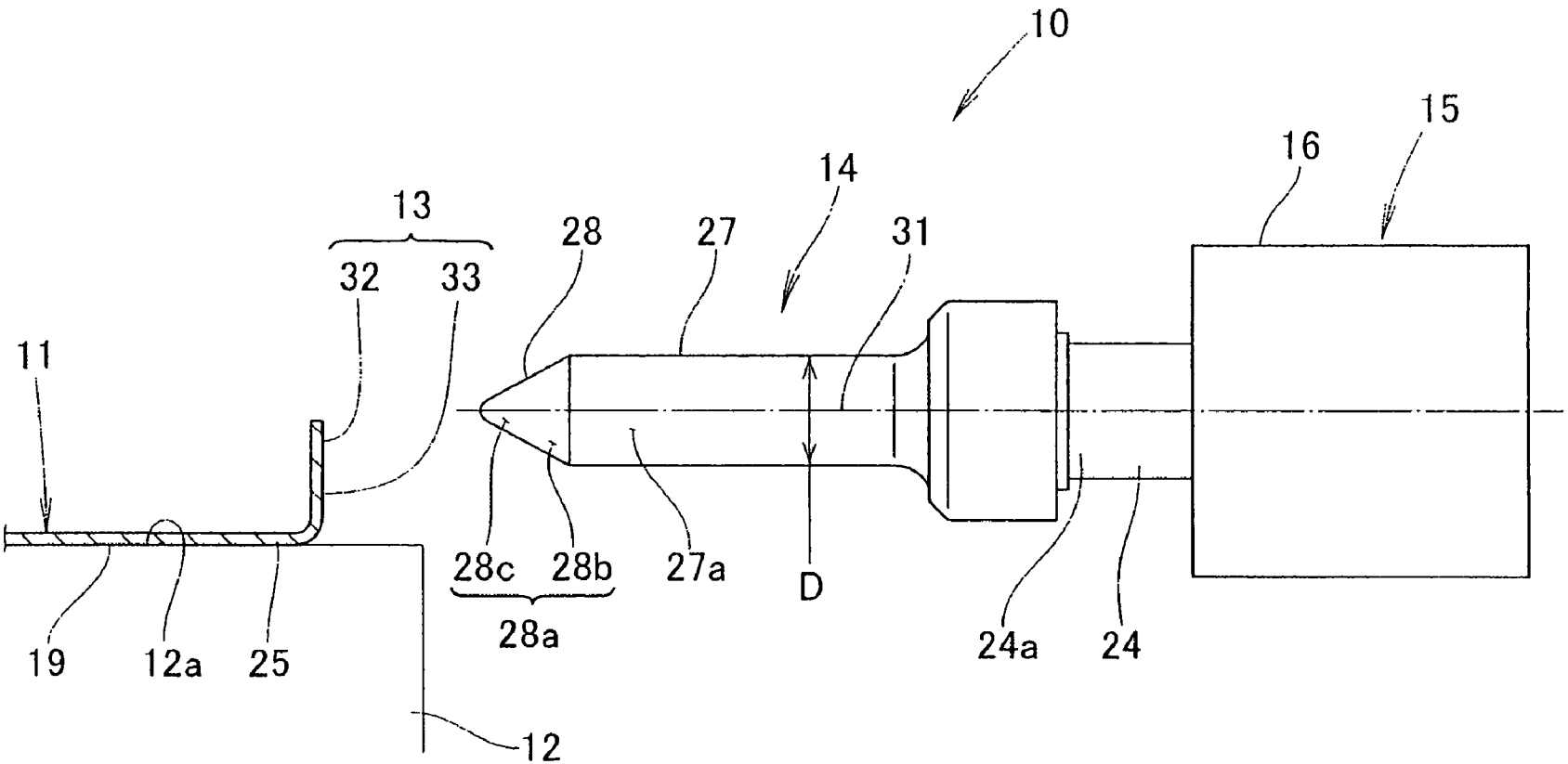
FIG. 1 is a schematic view showing an apparatus for carrying out a roller hemming method (first exemplary embodiment) according to the present invention.

FIG. 1 is a schematic view showing an apparatus as an implementation of a roller hemming method (first exemplary embodiment) according to the invention.

A roller hemming apparatus 10 is equipped with a workpiece mounting member 12 for holding a workpiece 11 at a working position, a working roller 14 for folding a flange 13 of the workpiece 11 that is held by the workpiece mounting member 12, and a robot 15 for supporting the working roller 14.

For example, the workpiece 11 is a plate-like (panel-like) row workpiece of a vehicle part and has a plate-like panel main body 19 and a flange 13 that is formed adjacent to a flange-proximate portion 25 as an end portion of the panel main body 19.

The flange 13 is a portion that is bent by about 90° with respect to the flange-proximate portion 25.

In a state that the workpiece 11 is placed on a surface 12*a* of the workpiece mounting member 12, the flange 13 is erected approximately perpendicularly to the surface 12*a*.

The working roller 14 is a member that is supported rotatably by an arm 24 of the robot 15. The working roller 14 has a full bending portion 27 and a tapered temporary bending portion 28 which is provided on the tip side of the full bending portion 27.

The full bending portion 27 has a circumferential surface (hereinafter referred to as "full bending circumferential surface") 27*a* which is parallel with an axial line 31 and is circular in cross section.

The full bending circumferential surface 27*a* is a circumferential surface for folding the flange 13 to a full bent state in which the flange 13 assumes a final shape, that is, the flange 13 is in contact with the flange-proximate portion 25 of the panel main body 19.

The temporary bending portion 28 has a circumferential surface (hereinafter referred to as "temporary bending circumferential surface") 28*a* which is inclined from the axial line 31 by about 45° and is circular in cross section.

The temporary bending circumferential surface 28*a* consists of a base-side circumferential surface 28*b* and a tip-side circumferential surface 28*c*. The base-side circumferential surface 28*b* is a surface for bending the flange 13 into a temporary bent state in which each of a tip-side portion 32 and a remaining, base-side portion 33 of the flange 13 assumes a temporary shape (inclined by about 45°).

The robot 15 is supported by a robot main body 16 in such a manner that the arm 24 can be moved three-dimensionally. The working roller 14 is attached rotatably to a tip portion 24*a* of the arm 24.

The working roller 14 can be moved along the flange 13 of the workpiece 11 by moving the arm 24 of the robot 15 three-dimensionally.

Figure 2:
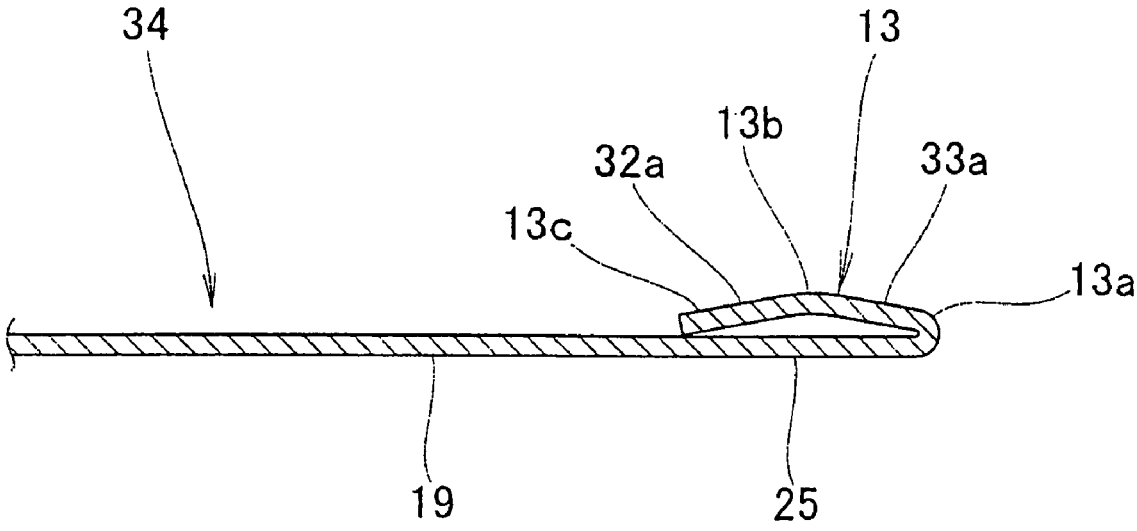
FIG. 2 is a sectional view of a hemmed member (first exemplary embodiment) according to the invention.

FIG. 2 is a sectional view of a hemmed member (first exemplary embodiment) according to the invention.

For example, a hemmed member 34 is a vehicle part obtained by hemming the workpiece 11 shown in FIG. 1. That is, the hemmed member 34 is a member obtained by folding the flange 13 so that it comes into contact with the flange-proximate portion 25. The flange 13 is folded at a base end 13*a* so as to face the flange-proximate portion 25 in its entirety.

More specifically, the flange 13 has a base-side bent portion 33*a* which is formed on the side of the base end 13*a* of the flange 13 and a tip-side bent portion 32*a* which is formed on the side of a tip 13*c* of the flange 13.

The tip-side bent portion 32*a* is a portion obtained by bending the tip-side portion 32 shown in FIG. 1. The tip-side bent portion 32*a* is inclined so as to come closer to the flange-proximate portion 25 as the position goes from a central portion 13*b* to the tip 13*c*.

The base-side bent portion 33*a* is a portion obtained by bending the remaining, base-side portion 33 shown in FIG. 1. The base-side bent portion 33*a* is inclined so as to go away from the flange-proximate portion 25 as the position goes from the base end 13*a* to the central portion 13*b*.

That is, the flange 13 of the hemmed member 34 is bent at the central portion 13*b* so as to form the tip-side bent portion 32*a* and the base-side bent portion 33*a* that assume a generally chevron-like shape, as a result of which the tip 13*c* of the flange 13 is in contact with the flange-proximate portion 25.

The example of FIG. 2 is such that the tip-side bent portion 32*a* and the base-side bent portion 33*a* are formed so that a crease is formed at the central portion 13*b*.

However, the invention is not limited such a case. The tip 13*c* can also be kept in contact with the flange-proximate portion 25 by bending the flange 13 so as to assume a generally chevron-like shape having a curved top portion by bending the tip-side bent portion 32*a* and the base-side bent portion 33*a* with the working roller 14 (see FIG. 1) so as not to form a crease.

Furthermore, even if a crease is formed when the tip-side bent portion 32*a* and the base-side bent portion 33*a* are formed temporarily so as to assume a generally chevron-like shape, the crease may disappear when the flange 13 is bent into a final shape.

Even in this case, stress that urges the flange 13 to restore a generally chevron-like shape remains in the flange 13. This stress maintains the state that the tip 13*c* is in contact with the flange-proximate portion 25.

Next, a method for hemming the workpiece 11 into the hemmed member 34 with the roller hemming apparatus 10 (that is, a roller hemming method according to the first exemplary embodiment) will be described with reference to FIGS. 3A to 5C.

Figure 3A:
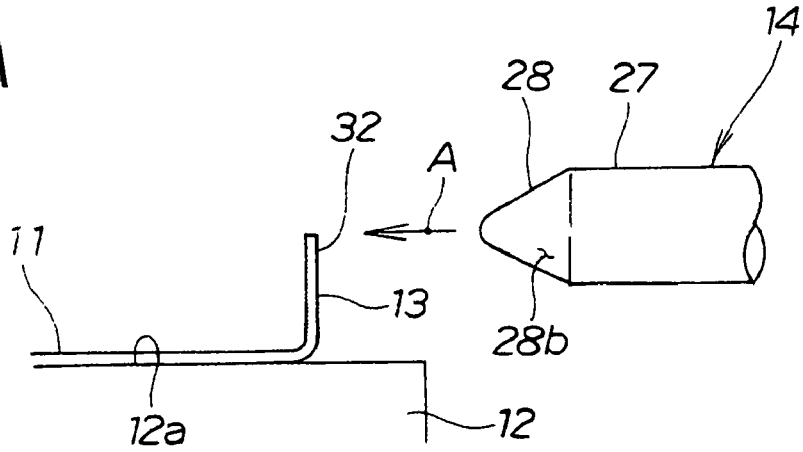
FIGS. 3A to 3C are views illustrating a first temporary bending step of bending a tip-side portion of a flange in the roller hemming method according to the first exemplary embodiment.
Figure 3B:
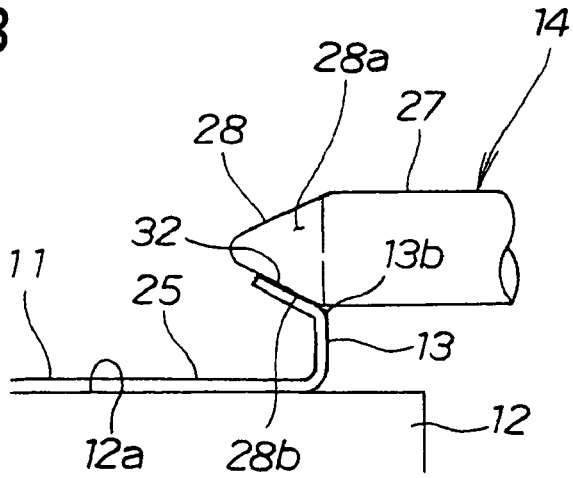
Figure 3C:
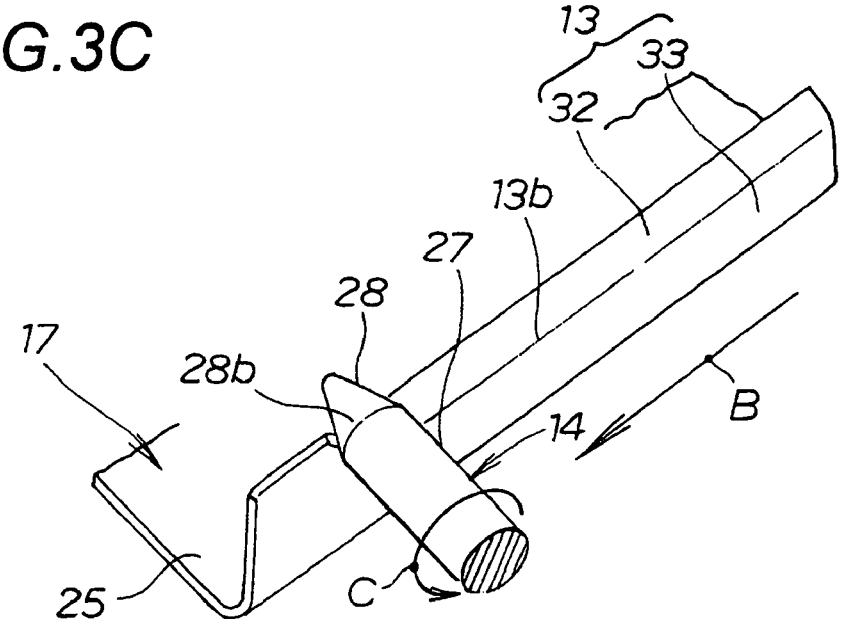

FIGS. 3A to 3C are views illustrating a first temporary bending step of bending the tip-side portion of the flange in the roller hemming method according to the first exemplary embodiment.

As shown in FIG. 3A, the workpiece 11 is mounted on the surface 12*a* of the workpiece mounting member 12. The flange 13 of the workpiece 11 is erected in advance approximately perpendicularly to the flange-proximate portion 25.

The working roller 14 is moved toward the tip-side portion 32 of the flange 13 as indicated by arrow A. The temporary bending portion 28 of the working roller 14 is moved toward the tip-side portion 32 of the flange 13.

As shown in FIG. 3B, of the temporary bending circumferential surface 28*a* of the temporary bending portion 28, the base-side circumferential surface 28*b* (i.e., the circumferential surface of a base-side portion of the temporary bending portion 28) is pressed against a temporary bending start portion of the tip-side portion 32 of the flange 13. The temporary bending start portion of the tip-side portion 32 is bent at the central portion 13*b* by about 45° to the side of the flange-proximate portion 25.

As shown in FIG. 3C, the working roller 14 is moved along a preset locus. That is, the working roller 14 is moved along the tip-side portion 32 of the flange 13 over its entire length as indicated by arrow B in a state that the base-side circumferential surface 28*b* is pressed against the tip-side portion 32.

As the working roller 14 is moved as indicated by arrow B, the working roller 14 is rotated as indicated by arrow C with the arm 24 (see FIG. 1) as an axis.

The tip-side portion 32 is thus bent by the base-side circumferential surface 28*b*, whereby the tip-side portion 32 is bent at the central portion 13*b* by about 45° to the side of the flange-proximate portion 25 over its entire length (a temporary shape is formed).

The first temporary bending step is thus completed.

In the first temporary bending step, the tip-side portion 32 is bent into the temporary shape by using only the base-side circumferential surface 28*b*, that is, without using the tip-side circumferential surface 28*c*. That is, to bend the flange 13 into the temporary shape, it is not necessary to use the entire temporary bending portion 28.

This prevents a waving phenomenon from occurring in the flange 13 when the tip-side portion 32 is bent into the temporary shape.

Figure 4A:
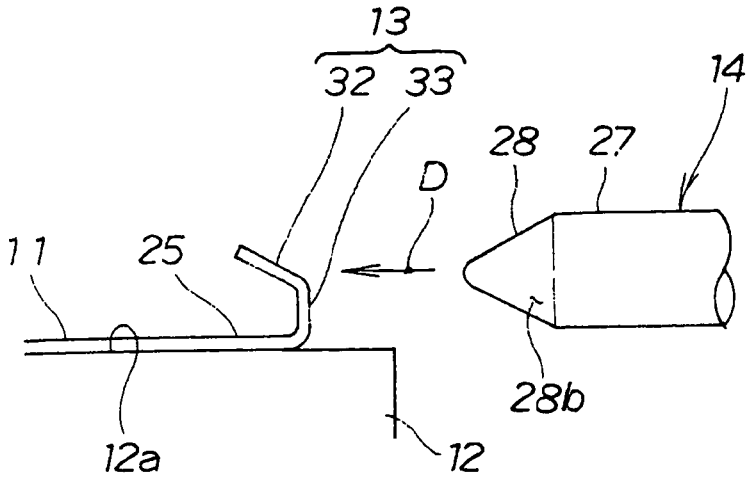
FIGS. 4A to 4C are views illustrating a second temporary bending step of bending a base-side portion of the flange in the roller hemming method according to the first exemplary embodiment.
Figure 4B:
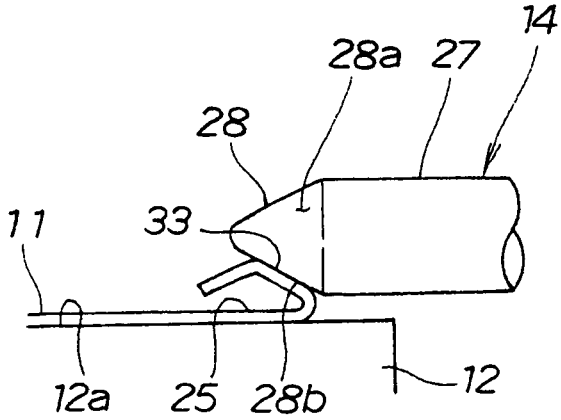
Figure 4C:
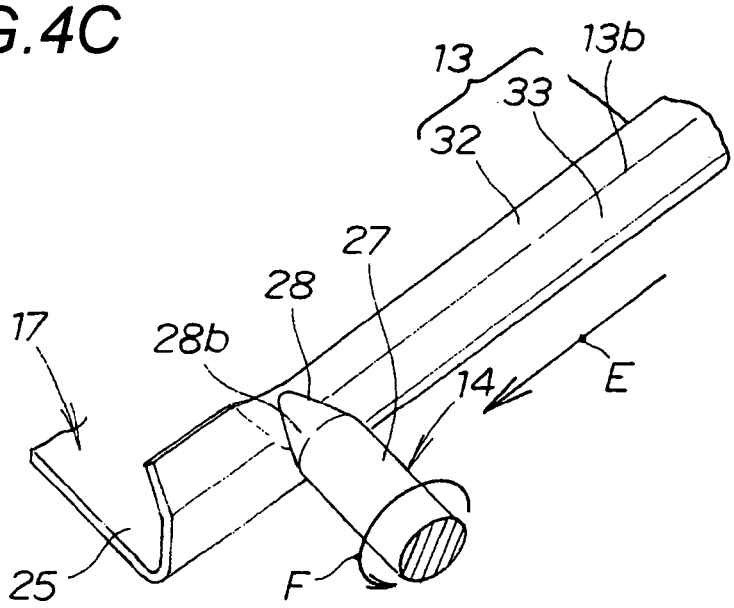

FIGS. 4A to 4C are views illustrating a second temporary bending step of bending the base-side portion of the flange in the roller hemming method according to the first exemplary embodiment.

As shown in FIG. 4A, the working roller 14 is moved toward the base-side portion 33 of the flange 13 as indicated by arrow D. The temporary bending portion 28 of the working roller 14 is moved toward the base-side portion 33 of the flange 13.

As shown in FIG. 4B, of the temporary bending circumferential surface 28*a* of the temporary bending portion 28, the base-side circumferential surface 28*b* is pressed against a temporary bending start portion of the base-side portion 33 of the flange 13. The temporary bending start portion of the base-side portion 33 is bent by about 45° to the side of the flange-proximate portion 25.

As shown in FIG. 4C, the working roller 14 is moved along the preset locus. That is, the working roller 14 is moved along the base-side portion 33 of the flange 13 over its entire length as indicated by arrow E in a state that the base-side circumferential surface 28*b* is pressed against the base-side portion 33.

As the working roller 14 is moved as indicated by arrow E, the working roller 14 is rotated as indicated by arrow F with the arm 24 (see FIG. 1) as an axis.

The flange 13 is thus bent by the base-side circumferential surface 28*b*, whereby the base-side portion 33 is bent by about 45° to the side of the flange-proximate portion 25 over its entire length (a temporary shape is formed).

The second temporary bending step is thus completed.

In the second temporary bending step, the base-side portion 33 is bent into the temporary shape by using only the base-side circumferential surface 28*b*, that is, without using the tip-side circumferential surface 28*c*. That is, to bend the flange 13 into the temporary shape, it is not necessary to use the entire temporary bending portion 28.

This prevents a waving phenomenon from occurring in the flange 13 when the base-side portion 33 is bent into the temporary shape.

As described above, a waving phenomenon can be prevented from occurring in the flange 13 in each of the first and second temporary being steps. The flange 13 can thus be folded satisfactorily.

As described above with reference to FIGS. 3A to 4C, the flange 13 can be folded so as to assume a generally chevron-like shape (see FIG. 4B) ) by bending the tip-side portion 32 of the flange 13 in the first temporary bending step so that it is inclined and bending the remaining, base-side portion 33 in the second temporary bending step so that it is inclined.

The reason why the flange 13 is folded so as to assume a generally chevron-like shape will be described later in detail with reference to FIG. 5C.

Figure 5A:
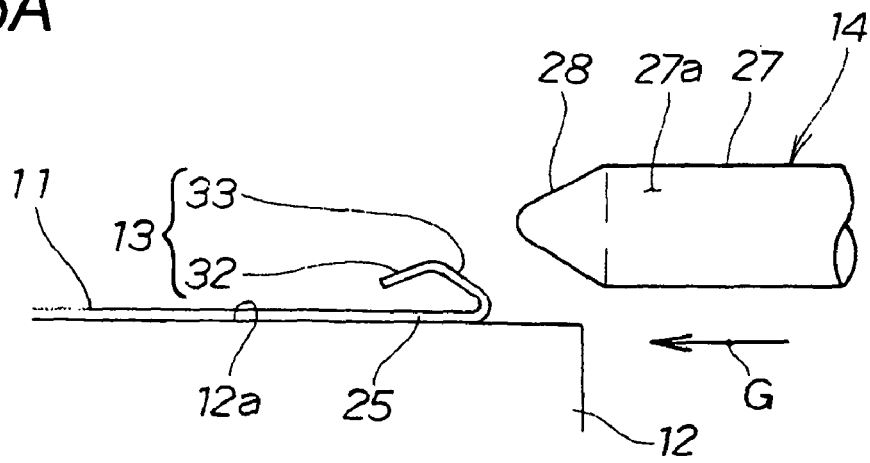
FIGS. 5A to 5C are views illustrating a full bending step of the roller hemming method according to the first exemplary embodiment.
Figure 5B:
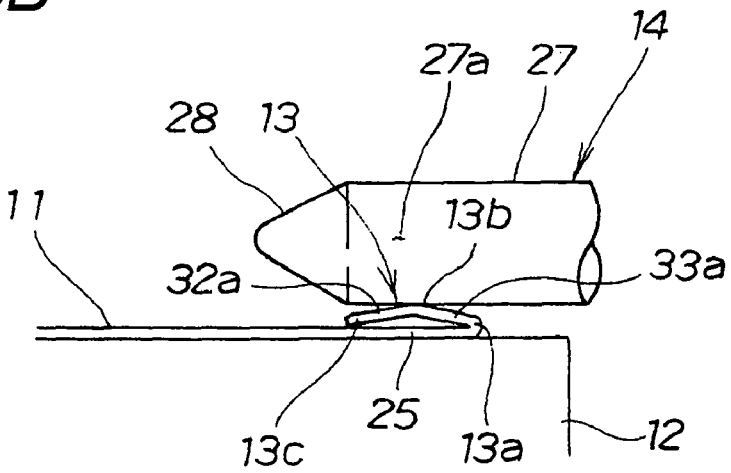
Figure 5C:
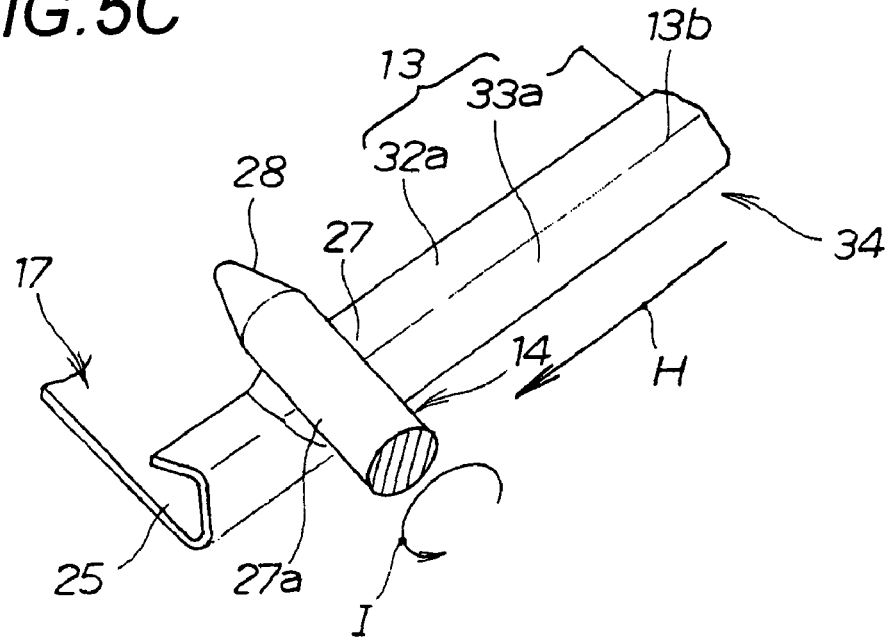

FIGS. 5A to 5C are views illustrating a full bending step of the roller hemming method according to the first exemplary embodiment.

As shown in FIG. 5A, the working roller 14 is moved toward the temporary bent flange 13 as indicated by arrow G. The full bending portion 27 of the working roller 14 is moved toward the flange 13 that has been folded temporarily so as to assume a generally chevron-like shape.

As shown in FIG. 5B, the full bending circumferential surface 27*a* of the full bending portion 27 is pressed against a full bending start portion of the temporary bent flange 13. The full bending start portion of the flange 13 is bent to the side of the flange-proximate portion 25.

Of that portion of the flange 13 against which the full bending circumferential surface 27*a* is pressed, the tip 13*c* is brought into strong contact with the flange-proximate portion 25 (i.e., urged toward the flange-proximate portion 25).

Although in this embodiment the tip 13*c* of the flange 13 is brought into contact with the flange-proximate portion 25, the entire portion of the flange 13 against which the full bending circumferential surface 27*a* is pressed may be brought into contact with the flange-proximate portion 25.

As shown in FIG. 5C, the working roller 14 is moved along the preset locus. That is, the working roller 14 is moved along the flange 13 over its entire length as indicated by arrow H in a state that the full bending circumferential surface 27*a* is pressed against the flange 13.

As the working roller 14 is moved as indicated by arrow H, the working roller 14 is rotated as indicated by arrow I with the arm 24 (see FIG. 1) as an axis.

The flange 13 is thus bent by the full bending circumferential surface 27*a*, whereby the flange 13 is bent to the side of the flange-proximate portion 25 over its entire length (a final shape is formed).

The flange 13 is bent over its entire length so that the tip-side bent portion 32*a* and the base-side bent portion 33*a* assume a generally chevron-like shape, whereby a hemmed member 34 is formed.

The full bending step is thus completed.

As shown in FIG. 5B, the flange 13 is folded so as to assume a generally chevron-like shape. That is, the flange 13 is inclined so as to go away from the flange-proximate portion 25 as the position goes from the base end 13*a* to the central portion 13*b* and to come closer to the flange-proximate portion 25 as the position goes from the central portion 13*b* to the tip 13*c*.

This allows the tip 13*c* of the flange 13 to be kept in contact with the flange-proximate portion 25 even after the flange 13 has been folded into the final shape.

In the first exemplary embodiment, a crease is formed at the central portion 13*b* when the tip-side portion 32 of the flange 13 is bent by the base-side circumferential surface 28*b* (see FIG. 3C). However, it is conceivable that a crease is not be formed at the central portion 13*b* when the tip-side portion 32 of the flange 13 is bent by the base-side circumferential surface 28*b*.

In the latter case, a resulting generally chevron-shaped flange 13 assumes a shape that is close to a curved shape. Even in this case, the tip 13*c* of the flange 13 is kept in contact with the flange-proximate portion 25.

Even in the case where a crease is formed at the central portion 13*b* when the tip-side portion 32 of the flange 13 is bent by the base-side circumferential surface 28*b* (see FIG. 3C), the crease may disappear when the flange 13 is bent into a final shape (fully bent state) by the full bending circumferential surface 27*a* (see FIG. 5C).

Even in this case, stress that urges the flange 13 to restore a generally chevron-like shape remains in the flange 13. As a result, the tip 13*c* of the flange 13 is kept in contact with the flange-proximate portion 25 even after the crease of the flange 13 is removed by the full bending circumferential surface 27*a*.

It was mentioned above with reference to FIG. 5B that there is a probability that the entire flange 13 is brought into contact with the flange-proximate portion 25. Even in this case, since stress that urges the flange 13 to restore a generally chevron-like shape remains in the flange 13, the flange 13 (especially the tip 13*c*) is kept in contact with the flange-proximate portion 25.

Comparative Example

Next, a process of folding a flange 101 temporarily using the whole of a temporary bending portion 102 of a working roller 100 will be described as a comparative example with reference to FIGS. 6A to 6D.

FIGS. 6A to 6D are views illustrating a roller hemming method of a comparative example.

Figure 6A:
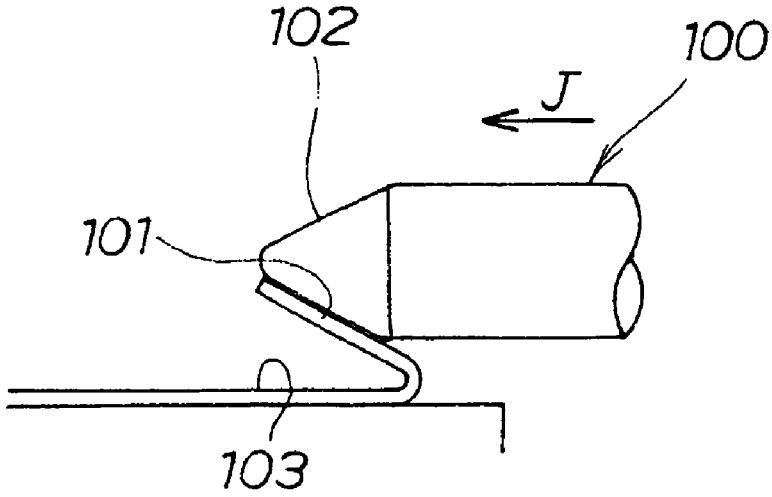
FIGS. 6A to 6D are views illustrating a roller hemming method of a comparative example.

As shown in FIG. 6A, the working roller 100 is moved toward the flange 101 as indicated by arrow J and a full-length portion of the circumferential surface of the temporary bending portion 102 is pressed against the flange 101. That portion of the flange 101 against which the temporary bending portion 102 is pressed is bent by about 45° to the side of a flange-proximate portion 103.

Figure 6B:
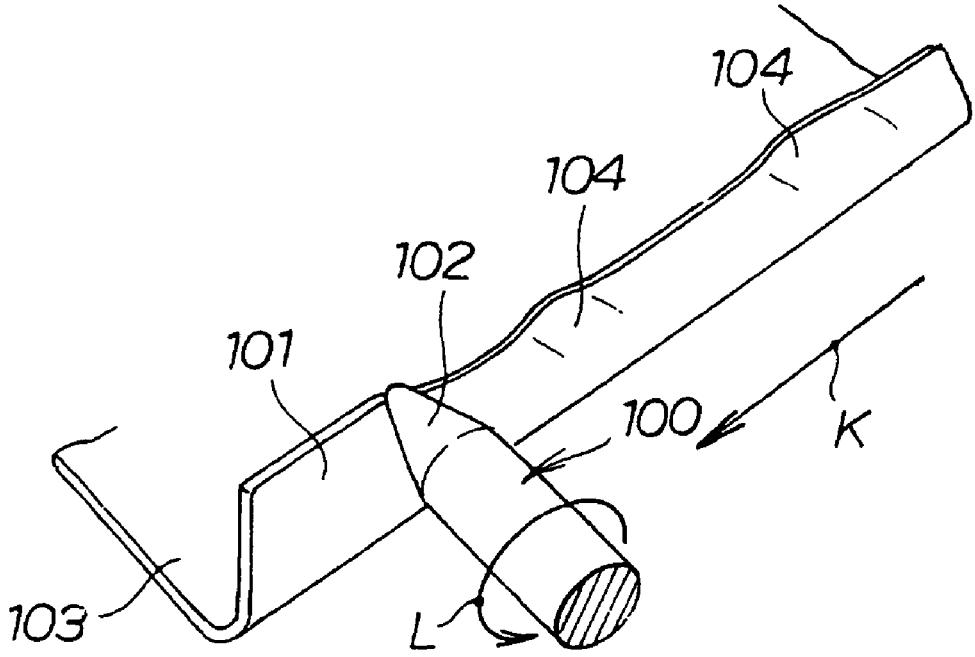

As shown in FIG. 6B, the working roller 100 is moved along a preset locus. That is, the working roller 100 is moved along the flange 101 over its entire length as indicated by arrow K in a state that the full-length portion of the temporary bending portion 102 is pressed against the flange 101. At this time, the working roller 100 is rotated as indicated by arrow L.

The flange 101 is bent by the entire circumferential surface of the temporary being portion 102, whereby the flange 101 is bent to the side of the flange-proximate portion 103 over its entire length (a temporary shape is formed).

Since the flange 101 is bent by the entire circumferential surface of the temporary being portion 102, a waving phenomenon 104 may occur in the flange 101.

Figure 6C:
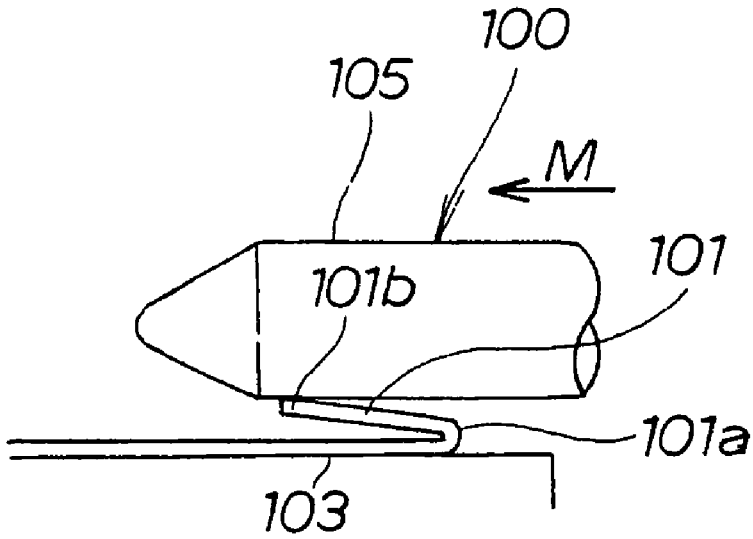

As shown in FIG. 6C, the working roller 100 is moved as indicated by arrow M and the circumferential surface of a full bending portion 105 is pressed against the flange 101.

That portion of the flange 101 against which the full bending portion 105 is pressed is bent to the side of the flange-proximate portion 103.

The waving phenomenon 103 occurred in the flange 101 at the time of the temporary bending. Therefore, a waving phenomenon 103 remains in the folded flange 101 to some extent even after the flange 101 have been folded to the side of the flange-proximate portion 103.

Therefore, a tip 101*b* of the flange 101 is hardly brought into contact with the flange-proximate portion 103 satisfactorily.

Figure 6D:
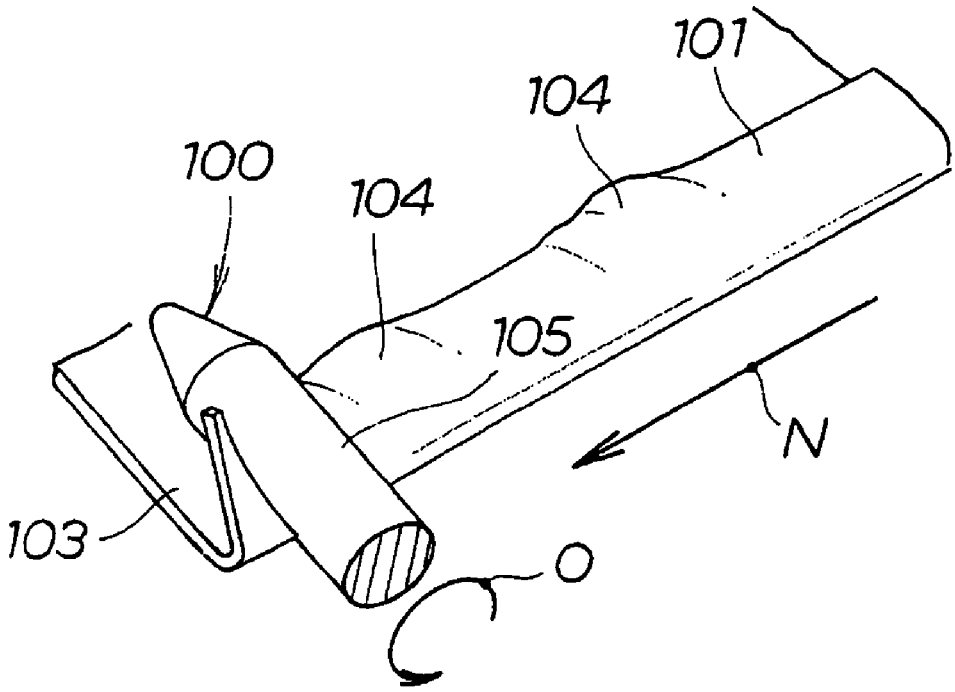

As shown in FIG. 6D, the working roller 100 is moved along the preset locus. That is, the working roller 100 is moved along the flange 13 over its entire length as indicated by arrow N in a state that the circumferential surface of the full bending portion 105 is pressed against the flange 101.

As the working roller 100 is moved as indicated by arrow N, the working roller 100 is rotated as indicated by arrow O.

The flange 101 is thus bent by the circumferential surface of the full bending portion 105, whereby the flange 101 is bent to the side of the flange-proximate portion 103 over its entire length (a final shape is formed).

As in the case of FIG. 6C, the flange 101 is folded obliquely so as to go away from the flange-proximate portion 103 as the position goes from a base end 101*a* to a tip 101*b*.

Therefore, the tip 101*b* of the flange 101 is hardly brought into contact with the flange-proximate portion 103 satisfactorily.

Second Exemplary Embodiment

Next, an example in which a hemmed member is formed by a roller hemming method according to a second exemplary embodiment will be described. The roller hemming method according to the second exemplary embodiment is such that a temporary bending step and a full bending step are executed by using the same circumferential surface of a working roller.

FIGS. 7A to 7D are views illustrating an example in which a hemmed member is formed by the roller hemming method (second exemplary embodiment) according to the invention.

Figure 7A:
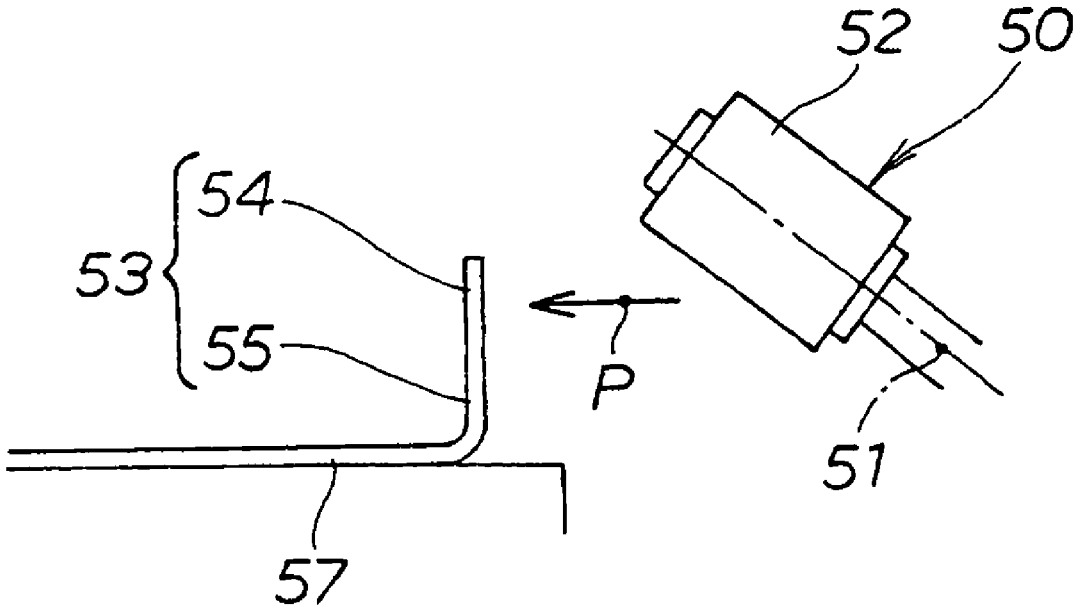
FIGS. 7A to 7D are views illustrating an example in which a hemmed member is formed by a roller hemming method (second exemplary embodiment) according to the invention.

As shown in FIG. 7A, a working roller 50 has a working circumferential surface 52 which is parallel with an axial line 51.

As shown in FIG. 7A, the working roller 50 is inclined and moved toward a tip-side portion 54 of a flange 53 as indicated by arrow P.

Figure 7B:
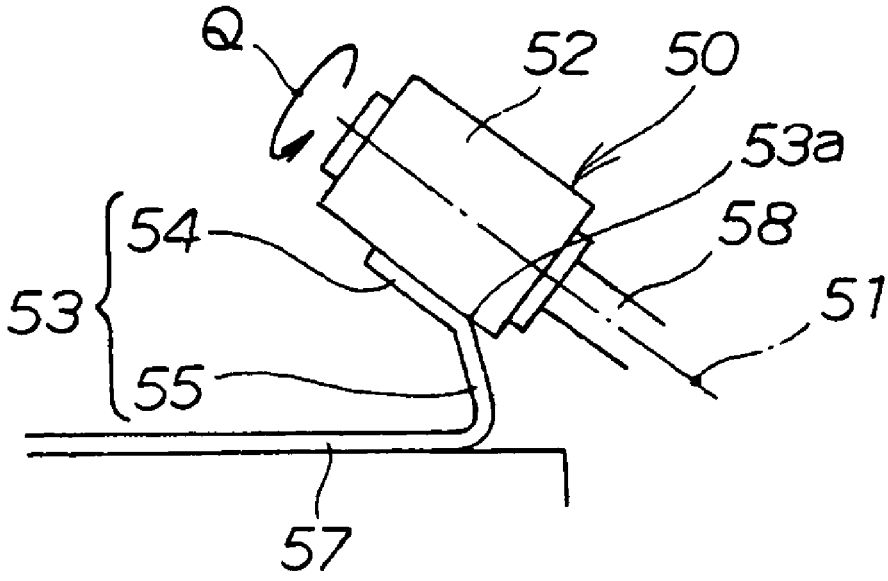

As shown in FIG. 7B, the circumferential surface 52 of the working roller 50 is pressed against a temporary bending start portion of the tip-side portion 54. The temporary bending start portion of the tip-side portion 54 is bent at a central portion 53*a* by about 45° to the side of a flange-proximate portion 57.

The working roller 50 is moved along a preset locus. That is, the working roller 50 is moved along the tip-side portion 54 over its entire length in a state that the circumferential surface 52 is pressed against the tip-side portion 54. At this time, the working roller 50 is rotated as indicated by arrow Q with an arm 58 as an axis.

The tip-side portion 54 is thus bent by the circumferential surface 52, whereby the tip-side portion 54 is bent at the central portion 53*a* by about 45° to the side of the flange-proximate portion 57 over its entire length (a temporary shape is formed)

A first temporary bending step is thus completed.

In the first temporary bending step, the tip-side portion 54 is bent by the circumferential surface 52 which is parallel with the axial line 51. This prevents a waving phenomenon from occurring in the flange 53.

Figure 7C:
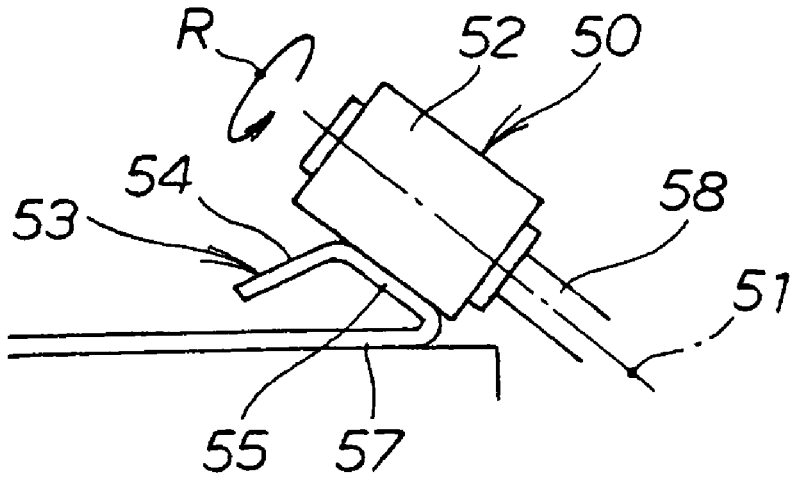

As shown in FIG. 7C, the circumferential surface 52 of the working roller 50 is pressed against a temporary bending start portion of a base-side portion 55. The temporary bending start portion of the base-side portion 55 is bent by about 45° to the side of the flange-proximate portion 57.

The working roller 50 is moved along the preset locus. That is, the working roller 50 is moved along the base-side portion 55 over its entire length in a state that the circumferential surface 52 is pressed against the base-side portion 55. At this time, the working roller 50 is rotated as indicated by arrow R with the arm 58 as an axis.

The base-side portion 55 is thus bent by the circumferential surface 52, whereby the base-side portion 55 is bent by about 45° to the side of the flange-proximate portion 57 over its entire length (a temporary shape is formed).

A second temporary bending step is thus completed.

In the second temporary bending step, the base-side portion 55 is bent by the circumferential surface 52 which is parallel with the axial line 51. This prevents a waving phenomenon from occurring in the flange 53.

As described above with reference to FIGS. 7B and 7C, the flange 53 can be folded so as to assume a generally chevron-like shape (see FIG. 7C) by bending the tip-side portion 54 of the flange 53 in the first temporary bending step so that it is inclined and bending the remaining, base-side portion 55 in the second temporary bending step so that it is inclined.

The reason why the flange 53 is folded so as to assume a generally chevron-like shape will be described later in detail with reference to FIG. 7D.

Figure 7D:
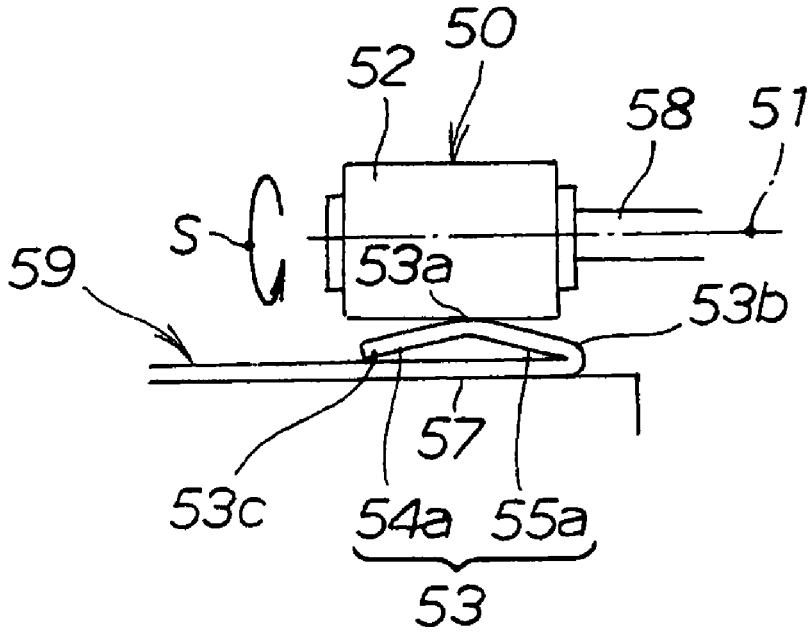

As shown in FIG. 7D, the working roller 50 is oriented horizontally and the circumferential surface 52 of the working roller 50 is pressed against a full bending start portion of the flange 53. The full bending start portion of the flange 53 is bent to the side of the flange-proximate portion 57.

Of that portion of the flange 53 against which the circumferential surface 52 is pressed, a tip 53*c* of the flange 53 is brought into strong contact with the flange-proximate portion 57 (i.e., urged toward the flange-proximate portion 57).

The working roller 50 is moved along the preset locus. That is, the working roller 50 is moved along the flange 53 over its entire length in a state that the circumferential surface 52 is pressed against the flange 53.

As the working roller 50 is moved over the entire length of the flange 53, the working roller 50 is rotated as indicated by arrow S with the arm 58 as an axis.

The flange 53 is thus bent by the circumferential surface 52, whereby the flange 53 is bent to the side of the flange-proximate portion 57 over its entire length (a final shape is formed).

The flange 53 is folded over its entire length so that a tip-side bent portion 54*a* and a base-side bent portion 55*a* assume a generally chevron-like shape, whereby a hemmed member 59 is formed.

The full bending step is thus completed.

As shown in FIG. 7C, the flange 53 is folded so that the tip-side portion 54 and the base-side portion 55 assume a generally chevron-like shape. That is, the flange 53 that has been folded into the final shape is inclined so as to go away from the flange-proximate portion 57 as the position goes from the base end 53*b* to the central portion 53*a* and to come closer to the flange-proximate portion 57 as the position goes from the central portion 53*a* to the tip 53*c*.

This allows the tip 53*c* of the flange 53 to be kept in contact with the flange-proximate portion 57 even after the flange 53 has been folded into the final shape.

As described above, the roller hemming method according to the second exemplary embodiment provides the same advantages as that according to the first exemplary embodiment.

In the first and second exemplary embodiments, the workpiece mounting member 12 is oriented with its surface 12*a* up. However, the invention is not limited to such a case. For example, the same advantages can be obtained also in the case where the workpiece mounting member 12 oriented with its surface 12*a* sideways.

In the first and second exemplary embodiments, the working roller 14 or 50 is moved with respect to the stationary flange 13 or 53. However, the invention is not limited to such a case. For example, the same advantages can be obtained also in the case where the flange 13 or 53 is moved with respect to the stationary working roller 14 or 50.

Furthermore, in the first and second exemplary embodiments, the tip-side portion 32 or 54 is inclined by about 45° in the first temporary bending step and the base-side portion 33 or 55 is inclined by about 45° in the second temporary bending step. However, the inclination angles of the temporary bending can be changed as appropriate.

The invention can suitably be applied to a roller hemming method for folding, with a working roller, a flange that is erected from a workpiece, as well as to a hemmed member.

It will be apparent to those skilled in the art that various modifications and variations can be made to the described exemplary embodiments of the present invention without departing from the spirit or scope of the invention. Thus, it is intended that the present invention cover all modifications and variations of this invention consistent with the scope of the appended claims and their equivalents.

DESCRIPTION OF REFERENCE NUMERALS

10 . . . Roller hemming apparatus; 11 . . . Workpiece; 13, 53 . . . Flange; 14, 50 . . . Working roller; 25, 57 . . . Flange-proximate portion; 27 . . . Full bending portion; 28 . . . Temporary bending portion; 28*b* . . . Base-side circumferential surface (circumferential surface of base-side portion of temporary bending portion); 32, 54 . . . Tip-side portion; 32*a*, 54*a* . . . Tip-side bent portion; 33, 55 . . . Base-side portion; 33*a*, 55*a* . . . Base-side bent portion; 34, 59 . . . Hemmed member.

What is claimed is:

1. A roller hemming method for folding a flange erected from a workpiece by pressing a working roller to the flange and moving the working roller, relative to the flange, wherein the working roller comprises a full bending portion and a tapered temporary bending portion provided on a tip side of the full bending portion the method comprising:

a first temporary bending step of bending a tip-side portion of the flange adjacent a mid-region of the flange with the tapered temporary bending portion of the working roller into a first state in which the tip-side portion is inclined;

a second temporary bending step of bending a base-side portion of the flange adjacent a base of the flange with the tapered temporary bending portion of the working roller into a second state in which the base-side portion is inclined; and a full bending step of bending the flange temporary bent in the first and second temporary bending steps with the full bending portion of the working roller into a third state in which the flange is into contact with a main body of the workpiece;

wherein the bending of the flange into each of the first and second states is done with a base-side portion of the temporary bending portion.

* * * * *